US012329286B2

(12) United States Patent
Liu

(10) Patent No.: US 12,329,286 B2
(45) Date of Patent: Jun. 17, 2025

(54) INFLATABLE AIR MATTRESS

(71) Applicant: CAREMED SUPPLY INC., New Taipei (TW)

(72) Inventor: Tsung-Hsuan Liu, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 216 days.

(21) Appl. No.: 18/358,420

(22) Filed: Jul. 25, 2023

(65) Prior Publication Data

US 2025/0031865 A1 Jan. 30, 2025

(51) Int. Cl.
*A47C 27/08* (2006.01)
*A47C 27/10* (2006.01)

(52) U.S. Cl.
CPC ..... *A47C 27/087* (2013.01); *A47C 27/10* (2013.01)

(58) Field of Classification Search
CPC ..... A47C 27/08; A47C 27/087; A47C 27/10; A47C 27/088; A61G 7/05715; A61G 7/05769
See application file for complete search history.

(56) References Cited

U.S. PATENT DOCUMENTS

2008/0028534 A1* 2/2008 Wilkinson ..... A61G 7/05769 5/713
2008/0201856 A1* 8/2008 Howard ..... A47C 31/123 5/690
2011/0004998 A1* 1/2011 Losio ..... A47C 23/002 5/699

* cited by examiner

*Primary Examiner* — Fredrick C Conley
(74) *Attorney, Agent, or Firm* — Rabin & Berdo, P.C.

(57) ABSTRACT

An inflatable air mattress includes a plurality of air cells arranged side by side. Every air cell includes an envelope, an elastomer, and a plurality of restriction straps. The envelope is inflatable and the elastomer is located inside the envelope. Each restriction strap includes two connection sections connected to a locating zone on the envelope, and a covering section located between the two connection sections to cover a part of the locating zone, such that a communicating gap is formed between the covering section and the envelope and the locating zone is divided into a central restricted area and an outer expandable area. The outer expandable area and the central restricted area are different in deformability. With the restriction straps, it is able to prevent the locating zones on the envelope from being over-deformed when the envelope is inflated and to prevent the deformed envelope from having an irregular shape.

7 Claims, 10 Drawing Sheets

INFLATABLE AIR MATTRESS

FIELD OF THE INVENTION

The present invention relates to an inflatable air mattress for a patient to lie thereon, and more particularly, to an inflatable air mattress that is restricted from over-deformation when being inflated.

BACKGROUND OF THE INVENTION

Patients who are suffering from paralysis, persistent vegetative state (PVS), stroke, and spinal cord injury are not freely movable by themselves. With limited mobility, these patients are usually confined to hospital beds over a long time without changing their position. As a result, the patients' skin under continued pressure is subjected to localized damages, such as forming blisters or getting skin-loss wounds. In some worse conditions, tissue necrosis caused by bedsore might occur at the patients' locally damaged skins. To avoid the bedridden patients from getting bedsore, they are usually lying on an air mattress during treatment. The conventional air mattress provides the functions of massaging the patients lying thereon and helping the patients to roll over, so that the patients can avoid localized skin necrosis.

The conventional air mattress consists of a plurality of deformable air cells. When the air cells are inflated using an inflation device, the air cells tend to deform and present different configurations in the process of inflation. As a result, the inflated air mattress would show an irregular shape, which is not comfortable for the patient to lie on. Further, since the air cells of the air mattress will deform irregularly when being inflated, holes tends to be formed on the air cells to cause air leakage and accordingly, reduce the service life of the air mattress.

SUMMARY OF THE INVENTION

A primary object of the present invention is to provide an inflatable air mattress including air cells with improved structural configuration, such that the air cells being inflated with an inflation device would not be over-deformed to result in irregularly shapes. Meanwhile, air leakage caused by holes formed in the inflation of the air cells can be reduced to prolong the service life of the air cells.

To achieve the above and other objects, the inflatable air mattress according to the present invention includes a plurality of air cells, which are arranged side by side to form a supporting bed for a patient. Each of the air cells includes an envelope, an elastomer, and a plurality of restriction straps.

The envelope internally defines an air chamber that is inflatable to expand, such that the envelope is capable of providing an inflation supporting force when the air cell is in an inflated state. Further, a plurality of locating zones are defined on the envelope. The elastomer is located in the air chamber defined by the envelope and is capable of providing a deflation supporting force when the air cell is in a deflated state. Each of the restriction straps includes two connection sections vertically spaced from each other and a covering section located between the two connection sections. A vertical linear distance between the two connection sections is defined as a strap width distance. The two connection sections on each of the restriction straps are connected to the same locating zone on the envelope, such that a communicating gap is formed between the covering section of the restriction strap and the envelope.

Each of the locating zones has a part being covered by the covering section, such that the locating zone is divided into a central restricted area and an outer expandable area. The outer expandable area has deformability different from that of the central restricted area.

In a preferred embodiment, when the air cell is in the inflated state, the central restricted areas on the envelope are deformed toward the covering sections to thereby change a cross-sectional shape of the communicating gaps. The restriction straps respectively have a deformation coefficient ranged between zero and a deformation coefficient of the envelope, such that the restriction straps respectively have deformability smaller than that of the envelope. When the central restricted areas on the envelope are deformed toward the covering sections, the restriction straps are deformed at the same time to shorten the strap width distance and one of the two connection sections of the same restriction strap is brought closer to the other of the two connection sections. In the preferred embodiment, when the air cell is in the inflated state, the central restricted areas on the envelope are in partial contact with the covering sections.

In another operable embodiment, the restriction straps respectively have a deformation coefficient of zero, such that the restriction straps are non-deformable and can limit the central restricted areas from deformation while the outer expandable areas are deformable when the air cell is in the inflated state. The central restricted areas limited by the non-deformable restriction straps are able to maintain an initial shape, such that the strap width distance of the restriction straps is unchanged and the communicating gaps keep their original cross-sectional shapes.

In the above two embodiments, the envelopes are respectively provided on each of four side surfaces with one locating zone; and the restriction straps are connected to the locating zones in one-to-one correspondence to limit the air cell from deformation in the x-axis and the y-axis.

The covering sections respectively include a plurality of covering sheets and a plurality of bending lines. Each of the bending lines is located between two adjacent covering sheets, such that the two adjacent covering sheets are connected to each other along the bending line with a sunken area formed on the covering section at each of the bending lines.

The present invention is characterized in that the air cell is formed of an envelope and a plurality of restriction straps. The locating zones defined on the envelope respectively have a part being covered by the restriction straps, so that the locating zones are respectively divided into a central restricted area and an outer expandable area. The outer expandable area has deformability smaller than that of the central restricted area. When the envelope is inflated and deformed, the locating zones are limited by the restriction straps from being over-deformed to prevent the air cell from forming an irregular shape. Meanwhile, air leakage caused by holes formed on the air cell in the process of inflating can be avoided to thereby prolong the service life of the air cell.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
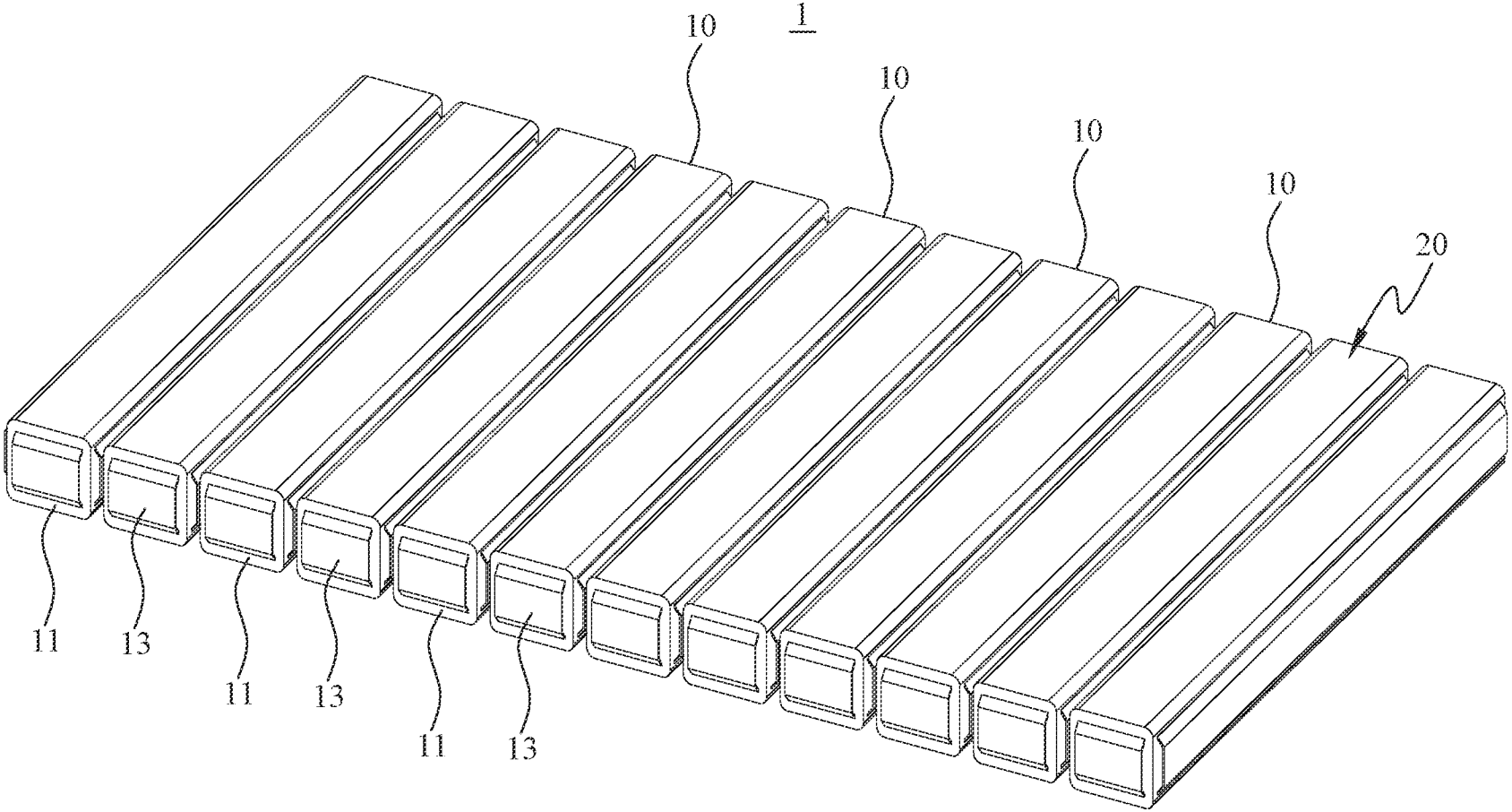
FIG. 1 is a perspective view of an inflatable air mattress according to the present invention.

The present invention will now be described with some preferred embodiments thereof and by referring to the accompanying drawings. For the purpose of easy to understand, elements that are the same in the preferred embodiments are denoted by the same reference numerals.

Figure 2:
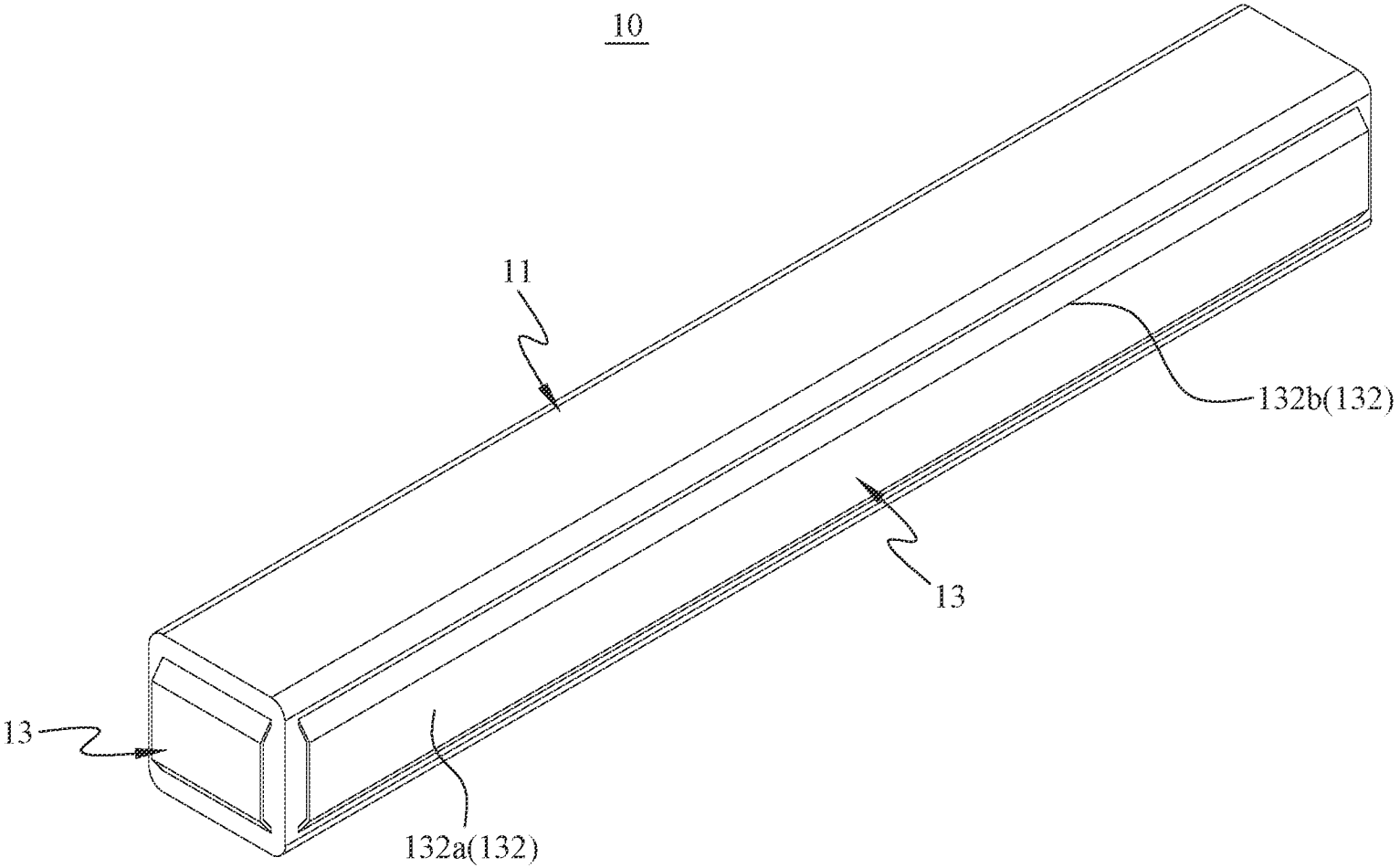
FIG. 2 is a perspective view of an air cell for the inflatable air mattress of the present invention according to a first embodiment thereof.
Figure 3:
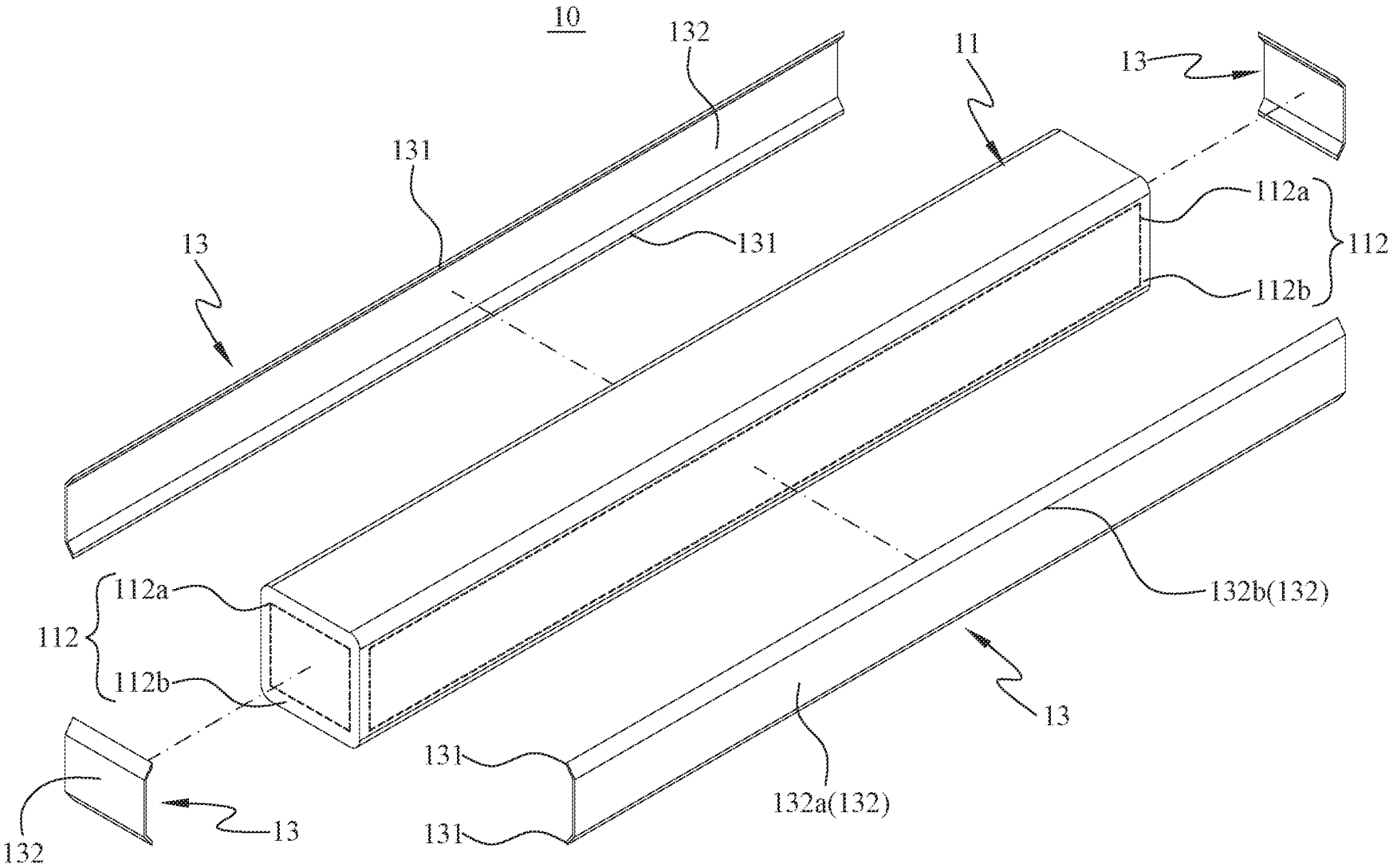
FIG. 3 is an exploded perspective view showing an envelope and a plurality of restriction straps of the air cell of the inflatable air mattress of the present invention.
Figure 4:
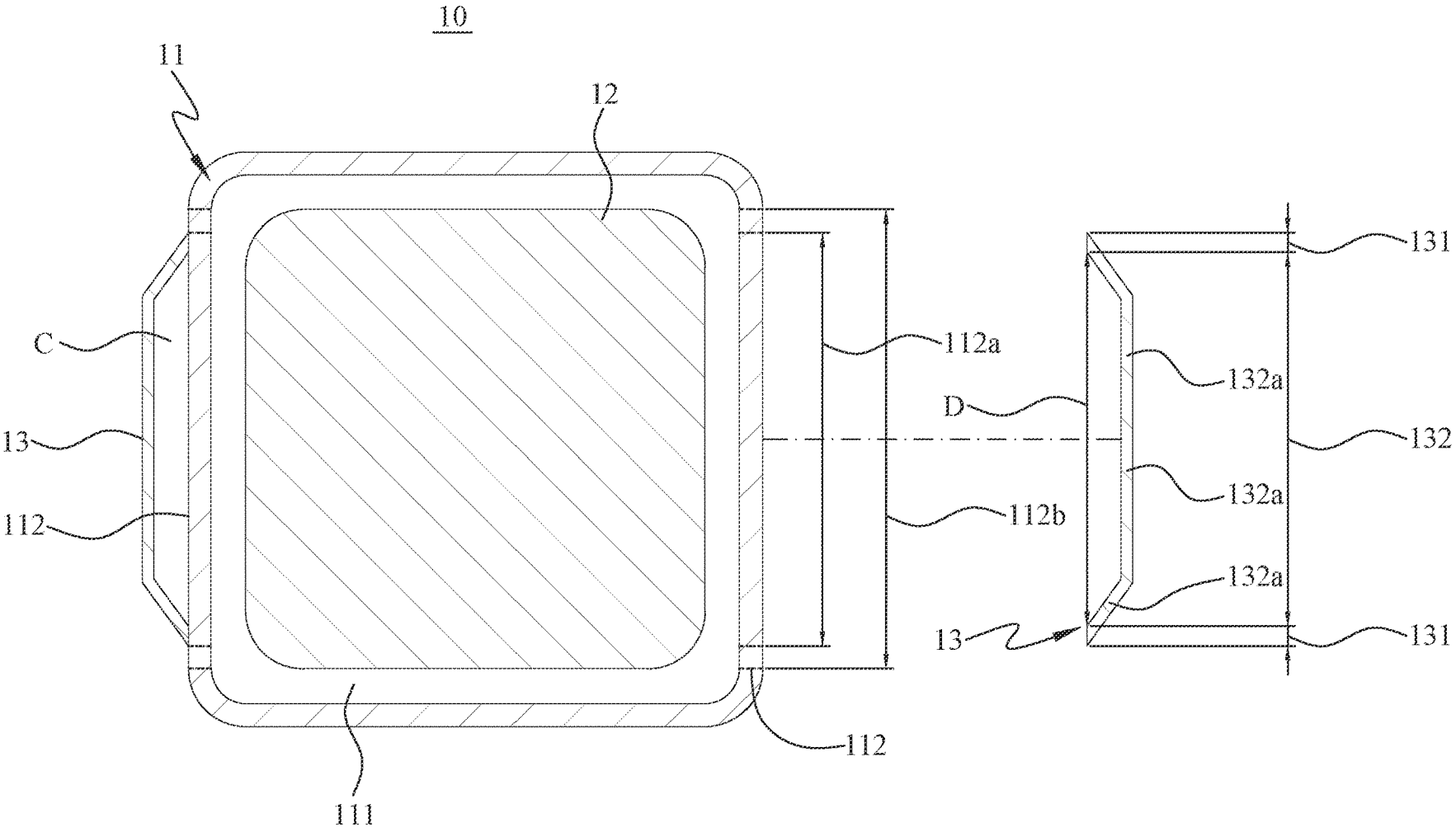
FIG. 4 is a partially exploded sectional view of the envelope and the restriction straps of the air cell of FIG. 3.

Please refer to FIG. 1, in which an inflatable air mattress 1 according to a preferred embodiment of the present invention is shown. The inflatable air mattress 1 includes a plurality of air cells 10 arranged side by side to form a supporting bed 20. As can be seen in FIGS. 2, 3 and 4, each of the air cells 10 includes an envelope 11, an elastomer 12, and a plurality of restriction straps 13. The envelope 11 is deformable and has a generally square-column configuration to define an internal air chamber 111. As shown, each of a front, a rear, a left and a right side surface of the envelope 11 is partially defined as a locating zone 112.

Figure 5:
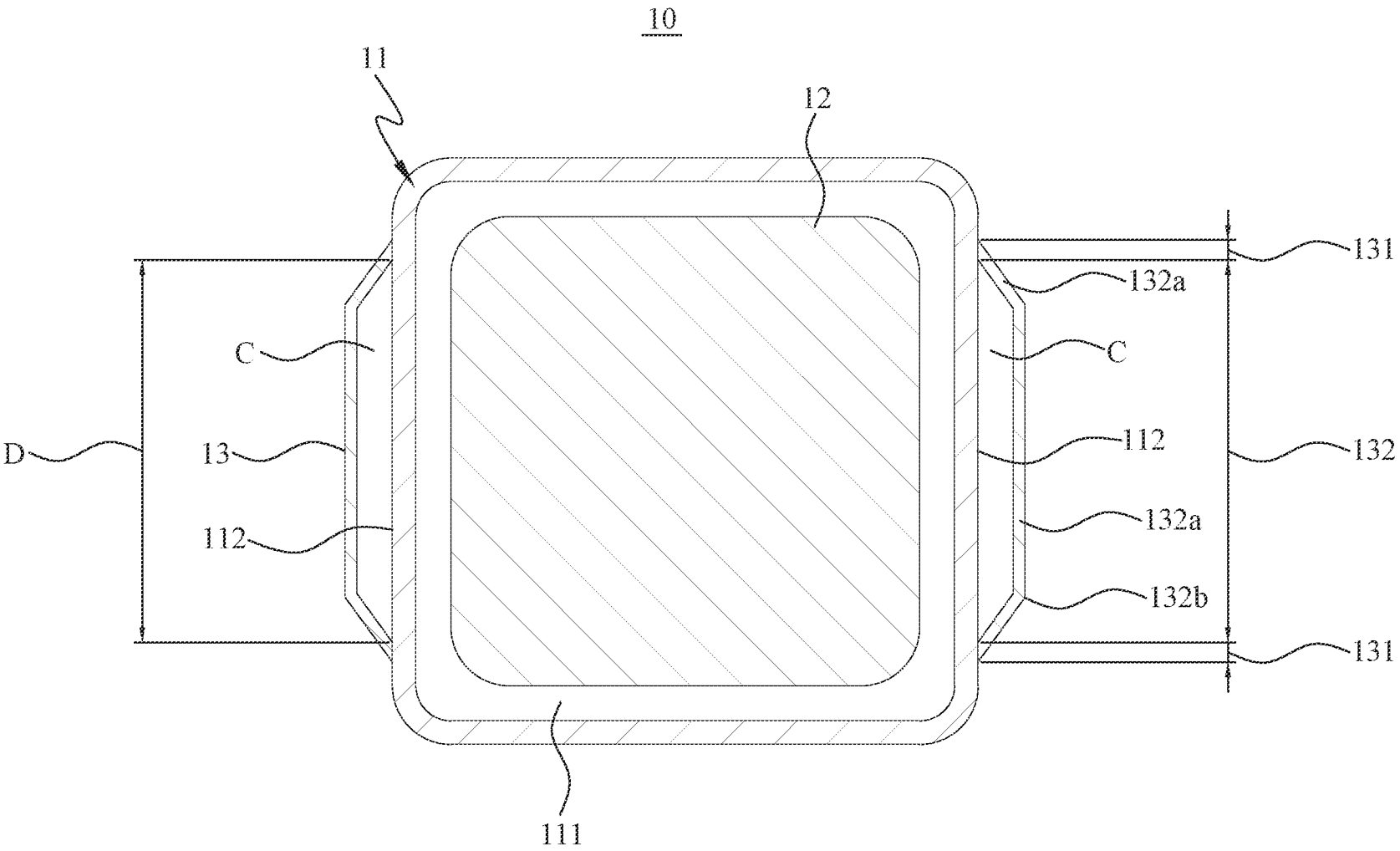
FIG. 5 is an end sectional view of the air cell of FIG. 2.
Figure 6:
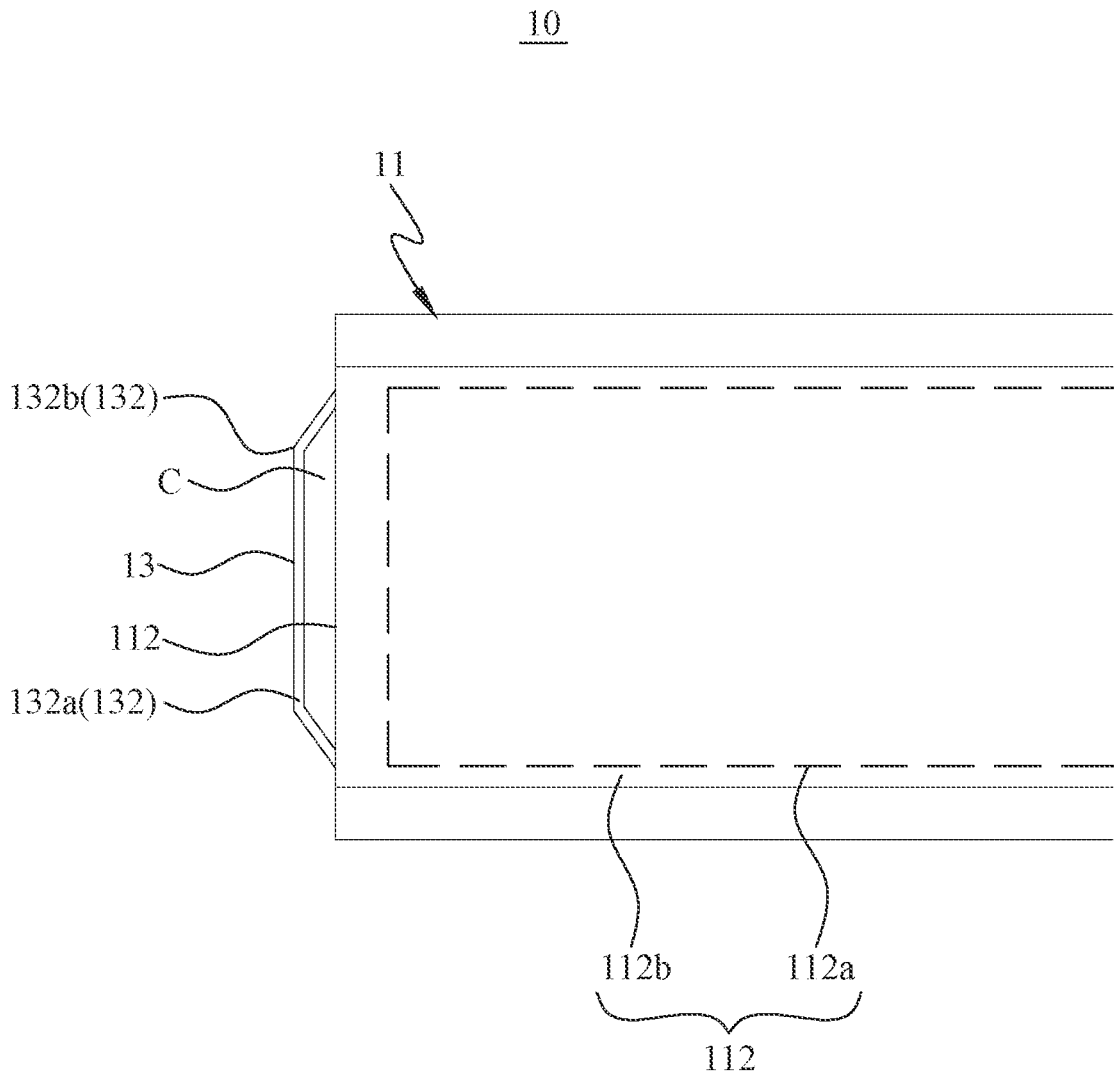
FIG. 6 is a fragmentary side view of the air cell with locating zones defined thereon.

Please refer to FIGS. 3, 4 and 5. The elastomer 12 of the air cell 10 is deformable and located in the air chamber 111 defined by the envelope 11. Each of the restriction straps 13 includes two connection sections 131 and a covering section 132. The two connection sections 131 are vertically spaced from one another, such that a vertical linear distance between the two connection sections 131 is defined as a strap width distance D. The covering section 132 is located between the two connection sections 131 and each includes a plurality of covering sheets 132*a* and a plurality of bending lines 132*b*. Each of the bending lines is located between two adjacent covering sheets 132*a*, such that the two adjacent covering sheets 132*a* are connected to each other along the bending line 132*b* and a sunken area is formed on the covering section 132 at each of the bending lines 132*b*. In the illustrated preferred embodiment, each of the restriction straps 13 has a deformation coefficient ranged between zero and a deformation coefficient of the envelope 11, so that the restriction strap has deformability smaller than that of the envelope 11. The two connection sections 131 of each restriction strap 13 are connected to the same locating zone 112 on the envelope 11, such that the covering section 132 covers a part of the locating zone 112 with a communicating gap C being formed between the covering section 132 and the locating zone 112. As can be seen in FIG. 6, when the two connection sections 131 of the restriction strap 13 are connected to the same one locating zone 112, a central part of the locating zone 112 being covered by the covering section 132 is defined as a central restricted area 112*a*, while other area of the locating zone 112 surrounding the central restricted area 112*a* and not covered by the covering section 132 is defined as an outer expandable area 112*b*. With the provision of the restriction strap 13 on each of the locating zones 112, the central restricted area 112*a* has deformability different from that of the outer expandable area 112*b*. With this arrangement, the air cell 10 is restricted by the restriction strap 13 to deform in the x-axis and the y-axis direction.

Figure 7A:
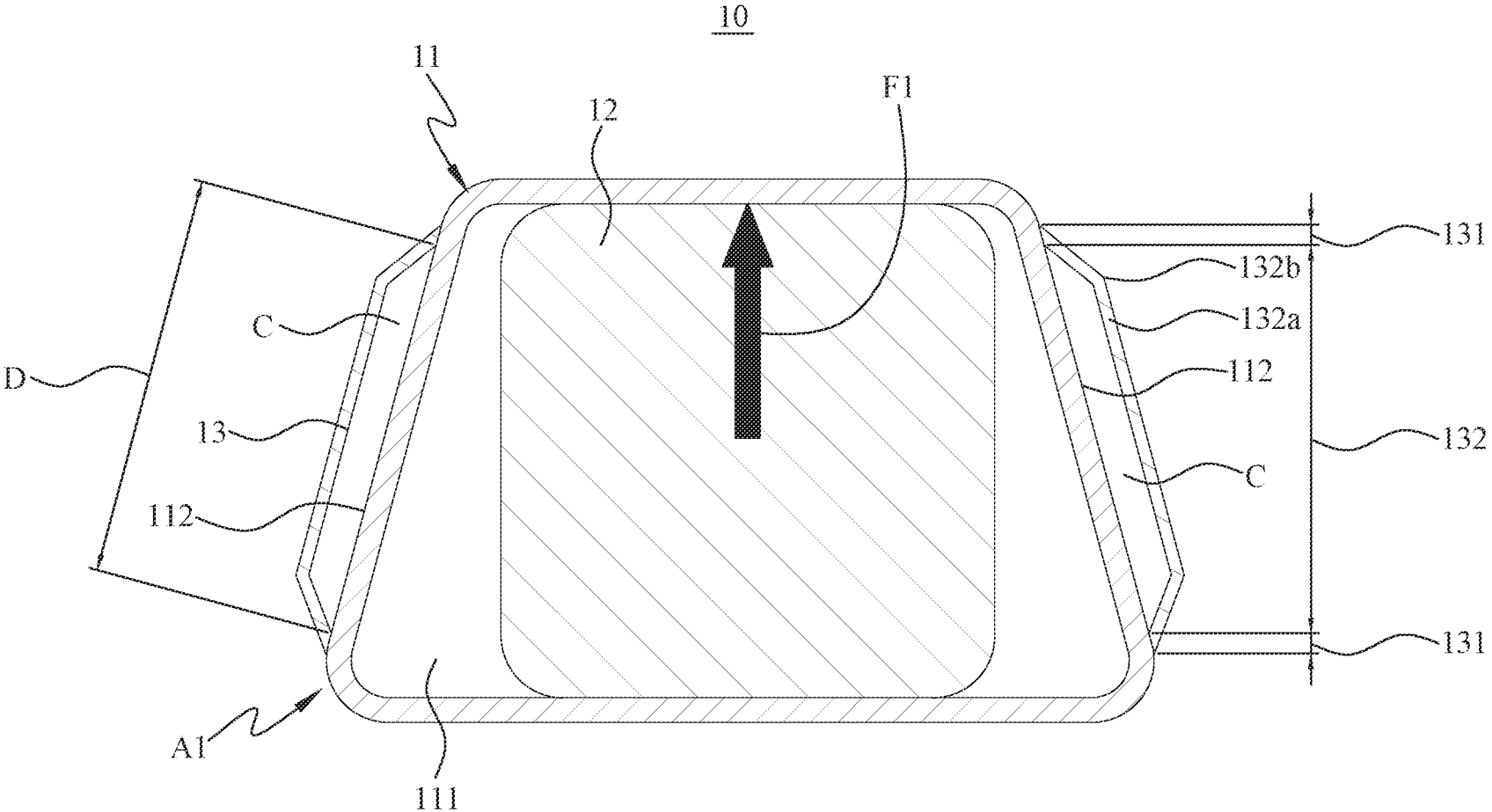
FIG. 7A is an end sectional view of the air cell for the first embodiment of the present invention in a deflated state.

Please refer to FIG. 7A, which shows the inflatable air mattress 1 of the present invention before it is inflated. When the inflatable air mattress 1 is not inflated, the envelope 11 of each air cell 10 is in touch with a top surface of the elastomer 12 in the air cell 10. The air cell 10 at this point is defined as in a deflated state A1. When the air cell 10 is in the deflated state A1, the elastomer 12 provides a deflation supporting force F1 to bear the weight of a patient lying on the supporting bed 20 of the inflatable air mattress 1.

Figure 7B:
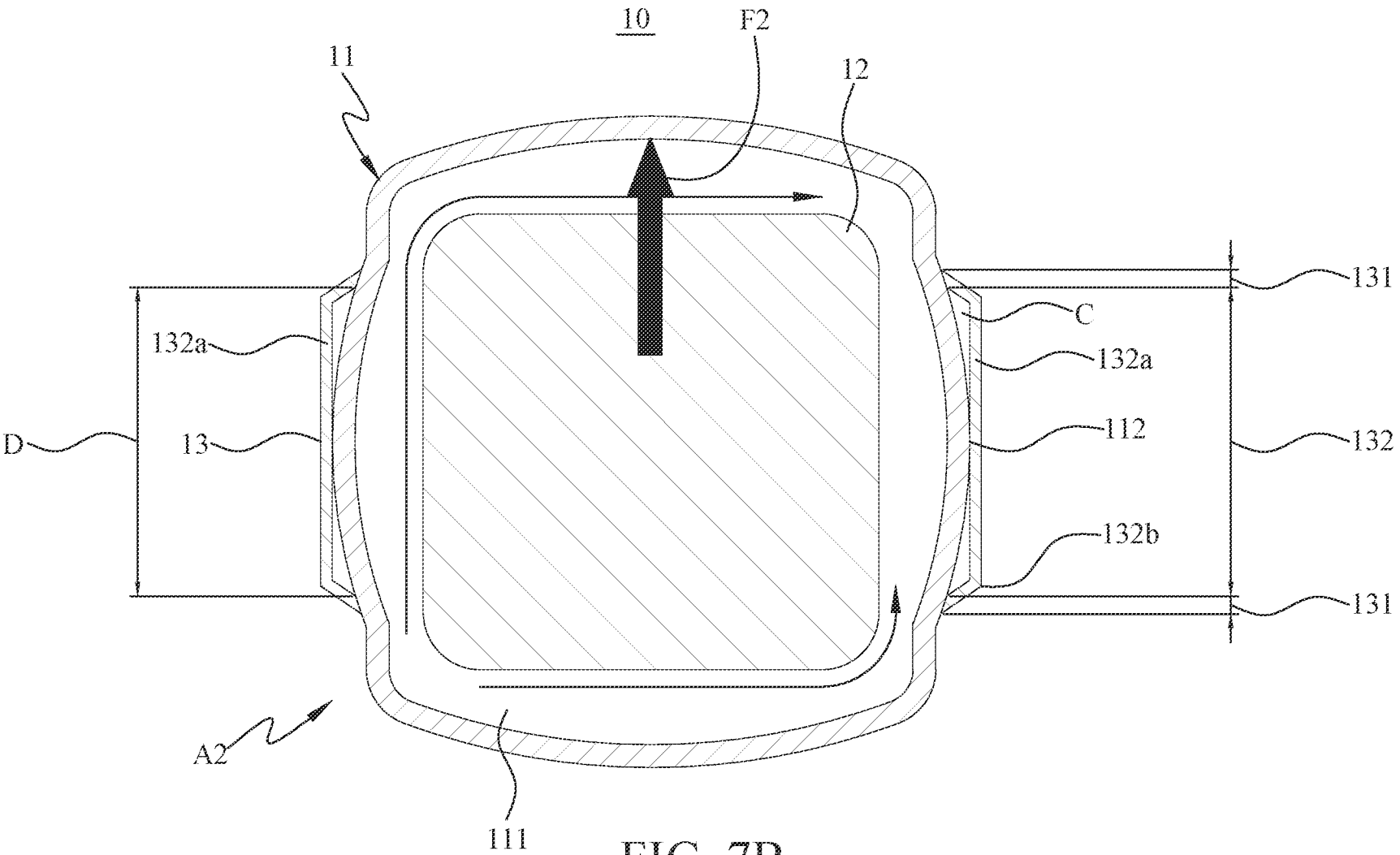
FIGS. 7B and 7C are end sectional views showing two possible conditions of the air cell of FIG. 7A in an inflated state.

Please refer to FIG. 7B, which shows the inflatable air mattress 1 of the present invention after it is inflated. Air can be supplied into the inflatable air mattress 1 using an inflating device (not shown). When the air flows into the air chambers 111 in the envelopes 11, the envelopes 11 are expanded to deform outward and the air chambers 111 are increased in size. At this point, the central restricted areas 112*a* on the envelopes 11 are deformed toward the covering sections 132 of the restriction straps 13. Meanwhile, the restriction straps 13 are also deformed and each of the covering sheets 132*a* of the covering sections 132 is expanded and pivotally turned about the bending lines 132*b* and accordingly, to move closer to an adjacent covering sheet 132*a*. At this point, a contained angle between any two adjacent covering sheets 132*a* is reduced, bringing the connection sections 131 of each restriction strap 13 to be located closer to each other. That is, the strap width distance D of the restriction straps 13 is shortened and the air cells 10 are changed from the deflated state A1 into an inflated state A2, which results in change of a cross-sectional shape of the communicating gaps C. When the envelopes 11 are deformed outward, the restriction straps 13 are able to restrict the outward deformability of the central restricted areas 112*a* of the locating zones 112 to be smaller than the deformability of the outer expandable areas 112*b*. In brief, when the envelopes 11 are expanded and deformed by the air filled thereinto, the central restricted areas 112*b* of the locating zones 112 are limited by the restriction straps 13 from being over-deformed, such that the air cells 10 are restricted by the restriction straps 13 from deformation in the x-axis and the y-axis direction and the envelopes 11 are prevented from having an irregular configuration after being deformed. Further, the provision of the restriction straps 13 is possible to avoid the condition of air leakage caused by the formation of one or more holes on the air cells 10 in the process of inflation and accordingly, prolong the service life of the air cells 10. In the illustrated preferred embodiment, when the air cells 10 are in the inflated state A2, the envelopes 11 of the air cells 10 can provide an inflation supporting force F2 to bear the weight of a patient lying on the supporting bed 20 of the inflatable air mattress 1, and the central restricted areas 112*a* on the envelopes 11 are in contact with the covering sections 132 of the restriction straps 13.

Figure 7C:
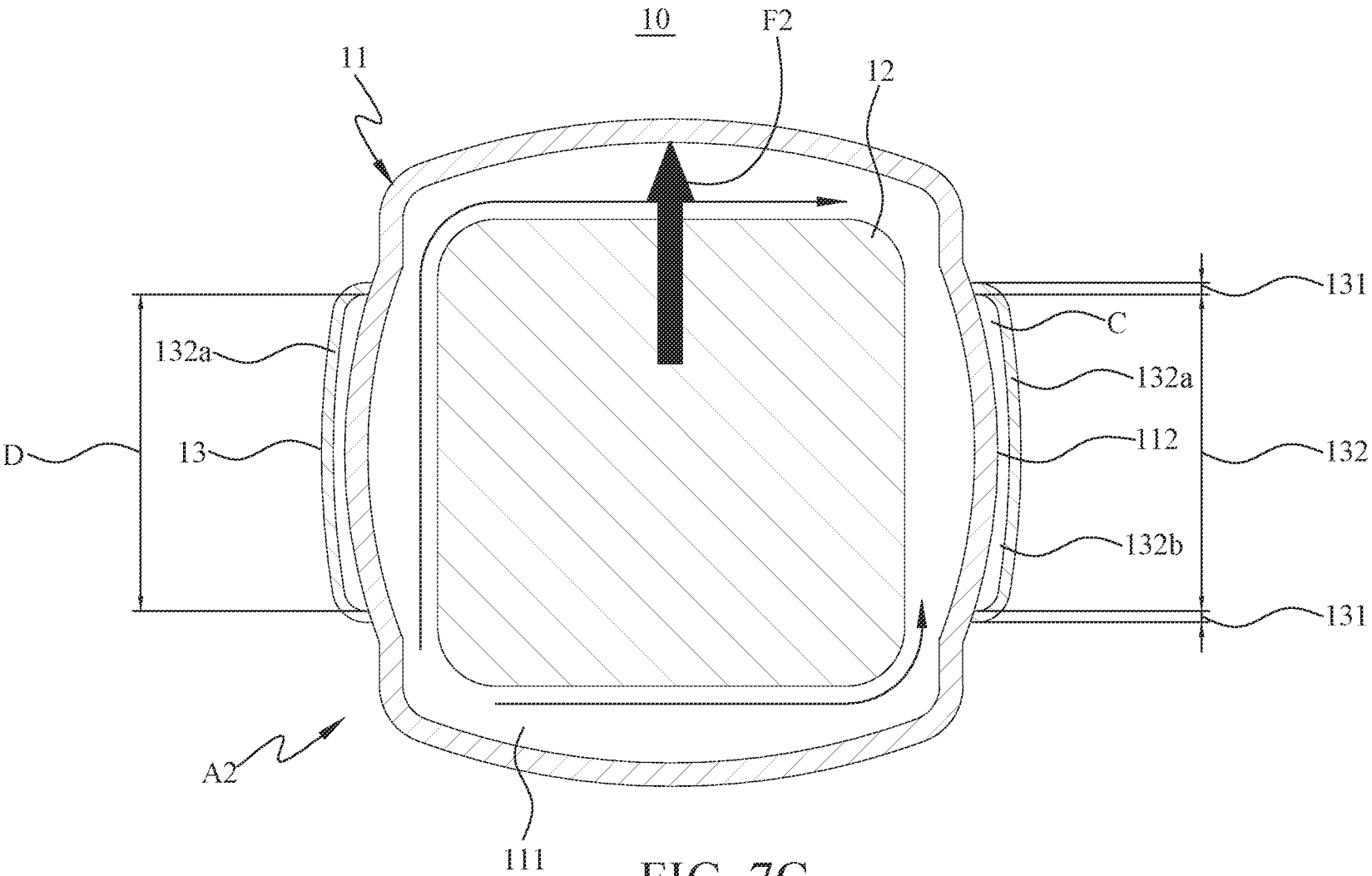

However, the above description that the contained angle between two adjacent covering sheets 132*a* will reduce when the central restricted areas 112*a* of the envelopes 11 are deformed toward the covering sections 132 of the restriction straps 13 is only illustrative. In another example as shown in FIG. 7C, when the central restricted areas 112*a* are deformed toward the covering sections 132 of the restriction straps 13, all the covering sheets 132*a* of the covering sections 132 are also deformed outward, such that every covering sheet 132*a* is convex relative to the central restricted area 112*a* of the envelope 11. In this case, the deformed central restricted areas 112*a* are not in contact with the covering sections 132.

Figure 8:
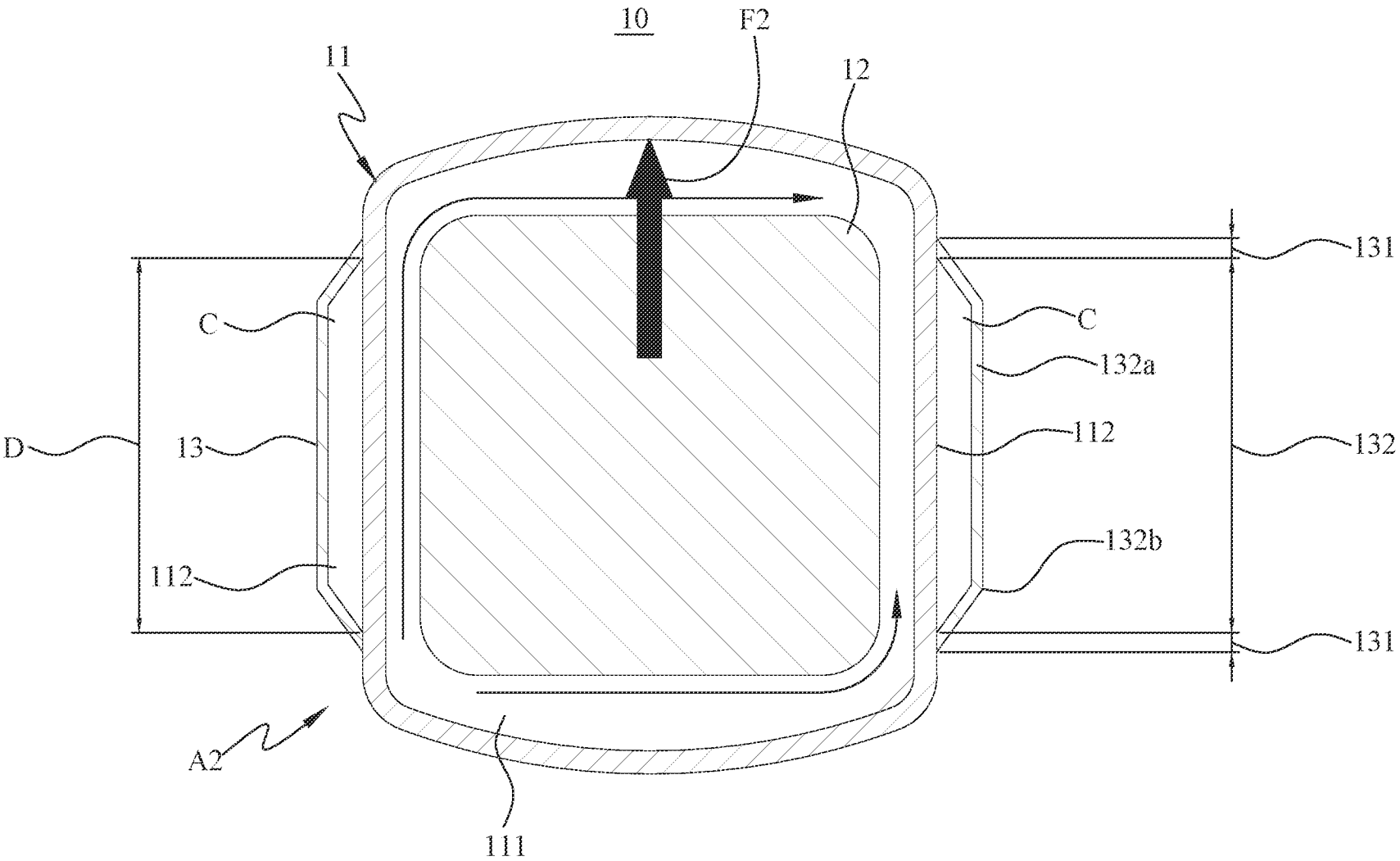
FIG. 8 is an end sectional view of an air cell according to a second embodiment of the present invention in an inflated state.

Please refer to FIG. 8, in which an air cell according to a second embodiment of the present invention is shown. The second embodiment is different from the preferred embodiment in that the restriction straps 13 of the second embodiment respectively have a deformation coefficient of zero. Since the air cells 10 in the second embodiment are structurally identical to that in the preferred embodiment, they are not repeatedly described herein.

In the second embodiment, since the restriction straps 13 on each air cell 10 has a deformation coefficient of zero, the restriction straps 13 are non-deformable and can therefore limit the central restricted areas 112*a* from deformation. In this case, when the envelope 11 is expanded by air supplied thereinto and the air cell 10 is in the inflated state A2, a top and a bottom side surface of the envelope 11 and the outer expandable areas 112*b* on the envelope 11 all are deformable while the central restricted areas 112*a* on the envelope 11 limited by the non-deformable restriction straps 13 do not deform to maintain their initial shapes. Therefore, the strap width distance D of the restriction straps 13 does not change and the communicating gaps C keep their original configuration.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An inflatable air mattress, comprising a plurality of air cells arranged side by side to form a supporting bed for being lain by a patient; and each of the air cells including:

an envelope internally defining an air chamber that is inflatable to expand, such that the envelope is capable of providing an inflation supporting force when the air cell is in an inflated state; and a plurality of locating zones are defined on the envelope;

an elastomer being located in the air chamber defined by the envelope and being capable of providing a deflation supporting force when the air cell is in a deflated state; and a plurality of restriction straps respectively including two connection sections vertically spaced from each other and a covering section located between the two connection sections, and a vertical linear distance between the two connection sections being defined as a strap width distance; and the two connection sections on each of the restriction straps being connected to the same locating zone on the envelope, such that a communicating gap is formed between the covering section of the restriction strap and the envelope; and wherein each of the locating zones has a part being covered by the covering section of the restriction strap, such that the locating zone is divided into a central restricted area and an outer expandable area; and the outer expandable area having deformability different from that of the central restricted area.

2. The inflatable air mattress as claimed in claim 1, wherein the central restricted areas on the envelopes are deformed toward the covering sections when the air cell is in the inflated state to thereby change a cross-sectional shape of the communicating gaps.

3. The inflatable air mattress as claimed in claim 2, wherein the restriction straps respectively have a deformation coefficient ranged between zero and a deformation coefficient of the envelope, such that the restriction straps respectively have deformability smaller than that of the envelope; and wherein when the central restricted areas on the envelope are deformed toward the covering sections, the restriction straps are deformed at the same time to shorten the strap width distance and one of the two connection sections of the same restriction strap is brought closer to the other of the two connection sections.

4. The inflatable air mattress as claimed in claim 2, wherein the central restricted areas on the envelope are in partial contact with the covering sections when the air cell is in the inflated state.

5. The inflatable air mattress as claimed in claim 1, wherein the restriction straps respectively have a deformation coefficient of zero, such that the restriction straps are non-deformable and can limit the central restricted areas from deformation while the outer expandable areas are deformable when the air cell is in the inflated state; and the central restricted areas limited by the non-deformable restriction straps being able to maintain an initial shape, such that the strap width distance of the restriction straps is unchanged and the communicating gaps keep their original cross-sectional shapes.

6. The inflatable air mattress as claimed in claim 1, wherein the envelopes are respectively provided on each of four side surfaces with one locating zone; and the restriction straps being connected to the locating zones in one-to-one correspondence to limit the air cell from deformation in the x-axis and the y-axis.

7. The inflatable air mattress as claimed in claim 1, wherein each of the covering sections includes a plurality of covering sheets and a plurality of bending lines; each of the bending lines being located between two adjacent covering sheets, such that the two adjacent covering sheets are connected to each other along the bending line with a sunken area formed on the covering section at each of the bending lines.

* * * * *